United States Patent [19]

Roberts et al.

[11] Patent Number: 4,862,677

[45] **Date of Patent: * Sep. 5, 1989**

[54] CASE PACKING APPARATUS

[75] Inventors: John T. Roberts, Clover; Philip L. Reid, Duncan, both of S.C.

[73] Assignee: John T. Roberts, Clover, S.C.

[ * ] Notice: The portion of the term of this patent subsequent to Jan. 6, 2004 has been disclaimed.

[21] Appl. No.: 170,118

[22] Filed: Mar. 15, 1988

Related U.S. Application Data

[63] Continuation of Ser. No. 925,565, Oct. 31, 1986, abandoned, which is a continuation of Ser. No. 666,046, Oct. 29, 1984, Pat. No. 4,633,653.

[51] Int. Cl.[4] ..... B65B 1/24; B65B 1/30; B65B 35/44; B65B 57/10

[52] U.S. Cl. ..... 53/498; 53/245; 53/246; 53/252; 53/527; 53/535; 53/537

[58] Field of Search ..... 53/252, 245, 246, 247, 53/255, 260, 498, 499, 500, 529, 534, 535, 537, 540, 542, 527

[56] References Cited

U.S. PATENT DOCUMENTS

| | | | |
|---|---|---|---|
| 3,594,977 | 7/1971 | Grasvoll | 53/255 X |
| 3,735,561 | 5/1973 | Wood | 53/535 X |
| 3,834,115 | 9/1974 | Johnson et al. | 53/537 X |
| 3,902,587 | 9/1975 | Checcucci | 53/537 X |
| 4,250,688 | 2/1981 | Ligenfelder | 53/252 X |
| 4,608,808 | 9/1986 | Ryan et al. | 53/535 X |
| 4,633,653 | 1/1987 | Roberts et al. | 53/535 X |

FOREIGN PATENT DOCUMENTS

| | | | |
|---|---|---|---|
| 169444 | 6/1965 | U.S.S.R. | 53/535 |
| 670611 | 4/1952 | United Kingdom | 53/535 |

*Primary Examiner*—Robert L. Sprull
*Assistant Examiner*—Beth Bianca
*Attorney, Agent, or Firm*—Bailey & Hardaway

[57] ABSTRACT

A case packing apparatus having a conveyor for moving a plurality of articles seriatim in a first direction to a location where means substantially perpendicular to the conveyor move a predetermined number of articles in the perpendicular direction into a case to form a layer within the case.

5 Claims, 4 Drawing Sheets

CASE PACKING APPARATUS

This application is a continuation, of application Ser. No. 06/925,565, filed 10/31/86, now abandoned, this application is a continuation, of application Ser. No. 06/666,046, filed Oct. 29, 1984 now U.S. Pat. No. 4,633,653.

BACKGROUND OF THE INVENTION

This invention relates generally to the art of conveying and more particularly to an apparatus for conveying a plurality of articles into a case for shipment.

Many and varied apparatus have existed within the prior art for conveying articles for ultimate packing into larger containers or cases for shipment or storage and sometimes even for shipment and display. The food distribution industry is particularly dependent upon the use of cases of individual articles for ultimate sale to the consumer through retailers or vending machines.

While many types of mechanical devices have been utilized by the food distribution industry, the handling and packing of fragile irregularly shaped articles has remained, to a large extent, a manual effort. Examples of such fragile and irregularly shaped articles include snack foods particularly those packed in flexible containers such as potato chips and other chip-type articles.

Even with regularly shaped articles, such as cigarette cartons which are packed into cases in rows, the packing effort is subject to a large degree of manual handling when such items are packed into tight-fitting cases.

Various apparatus have existed, however, which lend themselves to conveying and case packing, examples of which are given below.

U.S. Pat. No. 708,218 describes an apparatus for packing oil cakes. U.S. Pat. No. 3,735,561 describes an apparatus for packing single articles one at a time into a carton. U.S. Pat. No. 4,040,230 describes an apparatus for compacting garbage and placing into a container.

U.S. Pat. No. 3,826,058 describes an apparatus for inserting articles into a container while interleaving paper between layers.

U.S. Pat. No. 3,618,285 describes an apparatus for filling boxes with discreet articles such as fruit. U.S. Pat. No. 3,022,615 describes an apparatus for forming cartons about a plurality of articles. U.S. Pat. No. 2,956,381 describes an automatic packing apparatus for orienting and packing fragile articles within a shipping container.

None of the above prior art, however, overcomes any of the shortcomings which exist with regard to the case packing of a plurality of articles, particularly fragile articles which are irregularly shaped.

SUMMARY OF THE INVENTION

It is thus an object of this invention to provide a novel apparatus for packing a plurality of articles into cases. It is a further object of this invention to provide an apparatus for packing a plurality of fragile and irregularly shaped articles into a case for shipment.

It is a still further and more particular object of this invention to provide such an apparatus which is capable of handling regularly shaped articles and packaging them into tight fitting preformed containers.

These as well as other objects are accomplished by an apparatus having a conveyor for moving a plurality of articles seriatim in a first direction to a location where means substantially perpendicular to the conveyor move a predetermined number of articles in the perpendicular direction into a case to form a layer within the case. Means are provided for vertically moving said case downwardly to receive subsequent layers in a similar fashion.

DETAILED DESCRIPTION

In accordance with this invention, it has been found that a simple and effective apparatus may be provided for packing a plurality of articles into a case. The invention has mechanical advantages in that it is adaptable through the various embodiments for handing irregularly shaped fragile articles as well as regularly shaped articles. Various other advantages and features will become apparent from the following description given with reference to the various figures of drawing.

Figure 1:
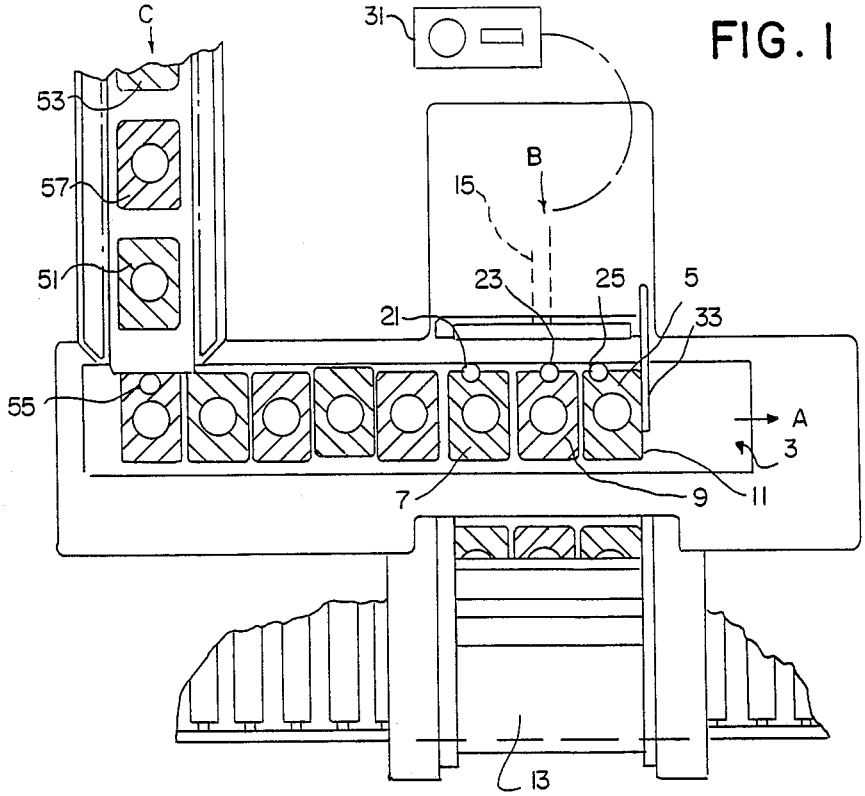
FIG. 1 is a plan view in schematic form of the apparatus in accordance with this invention.

FIG. 1 illustrates in plan view the apparatus for packing a plurality of articles into a case in accordance with this invention. As is apparent from FIG. 1, a first conveying means 3 conveys a plurality of articles 5 in a horizontal direction indicated generally by arrow A. As illustrated in FIG. 1 of the drawings, three individual articles 7, 9 and 11 appear stationed before a case 13. While three articles are illustrated as being ready for movement into case 13, it is understood that any predetermined number of articles can be handled by the apparatus in accordance with this invention so as to move the articles into a suitably sized case such as 13.

Means 15 move substantially perpendicularly to the direction of the first conveying means along the direction indicated by arrow B. Actuation of means for moving 15 is brought about by detection means 21, 23, and 25 such as photoelectric detectors detecting the presence of three articles 7, 9, and 11 stationed before case 13.

Controller 31 is in electrical communication with detection means 21, 23, and 25 and actuates means for moving 15 upon the presence of such articles at the desired location adjacent case 13.

As illustrated in FIG. 1, first conveying means 3 may be interrupted by controller 31 upon the detection of the predetermined number of articles adjacent to case 13 at the loading location. This is particularly desirable for irregularly shaped articles such as flexible containers of snack foods. In the event, however, of regularly shaped articles, the movement of articles may be interrupted by a stop such as 33 while permitting the first conveying means 3 to continue sliding therebeneath.

Figure 2:
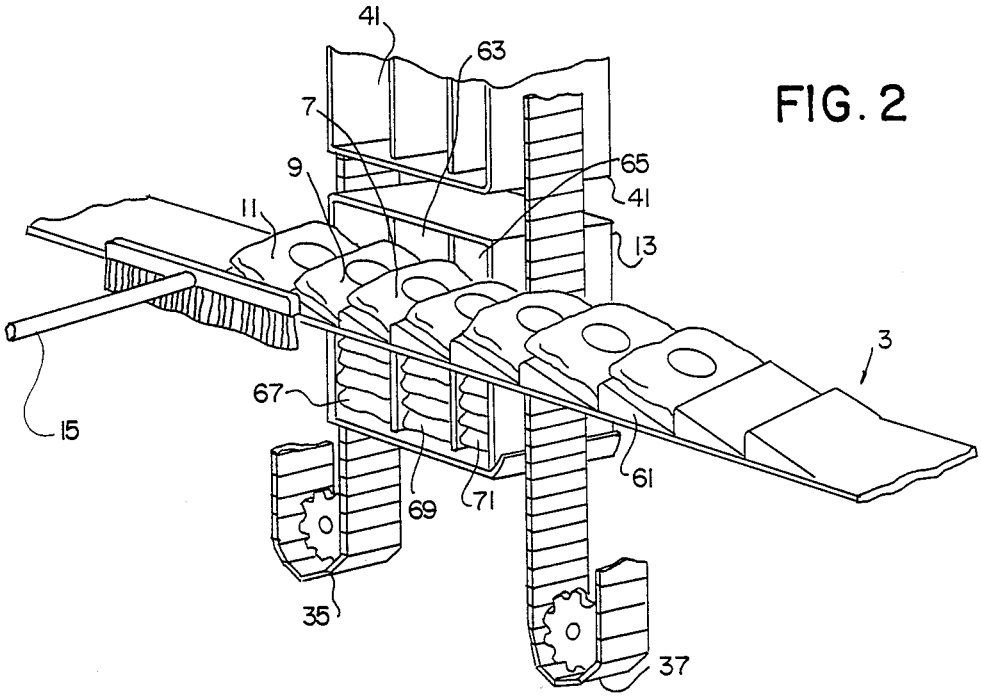
FIG. 2 is a further schematic view in a frontal plane of the apparatus in accordance with this invention.

Upon actuation of means for moving 15 which is generally and preferably a pusher or sweeper as is best illustrated schematically in FIG. 2 of the drawings, pusher 15 merely moves the individual articles as a generally single layer into open carton 13.

Means 35 and 37 are provided for vertically moving case 13 downwardly after receipt of a layer of articles. After receipt of the predetermined number of articles, detection means 21, 23, and 25 through control 31 activate vertical movement means 35 and 37 as well as conveyor 3 to move subsequent articles seriatim into the loading location. The apparatus continues to operate until a predetermined number of layers have been established within carton 13.

Figure 3:
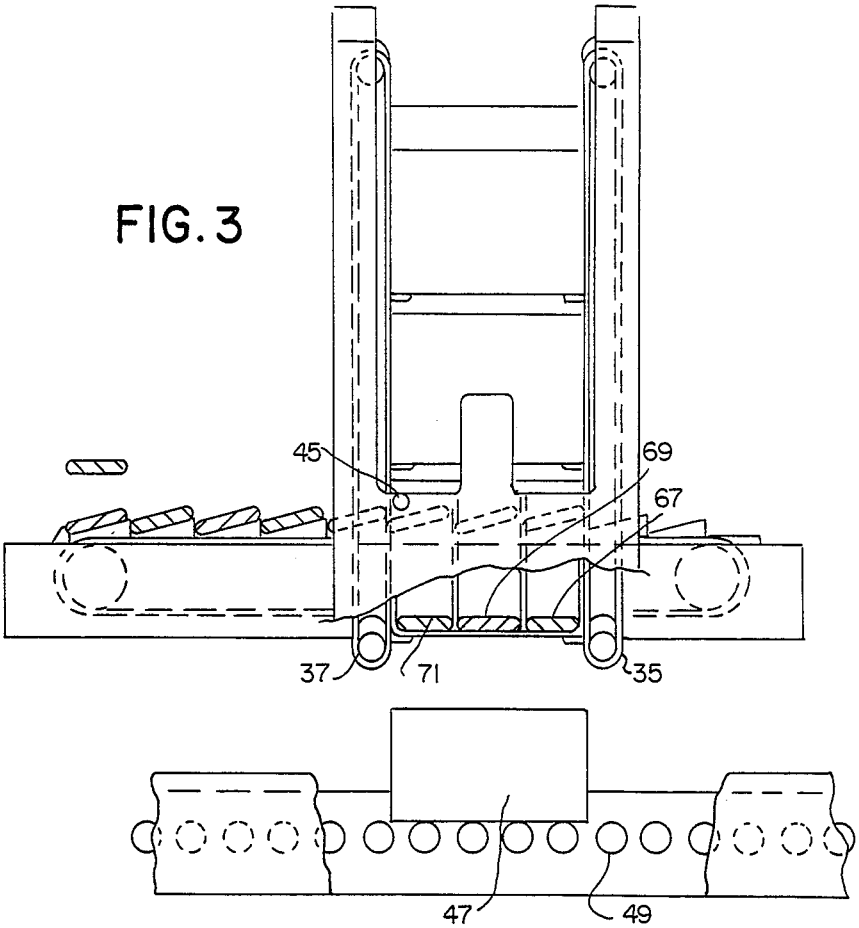
FIG. 3 of the drawings is a rear view of the FIG. 1 view of the drawings.

Controller 31 is set to establish an appropriate predetermined number of layers. When the predetermined number of layers is established, carton 13 is discharged from beneath conveyors 35 and 37, and a new carton 41, partially shown in FIG. 2 moves vertically downwardly until an appropriate position is detected by detection means 45, FIG. 3, in communication with controller 31. At this point the means for vertically moving the case downwardly cease operation until a layer of articles is established within the case. This is best illustrated in FIG. 3 of the drawings wherein a previously loaded case 47 is illustrated on exit conveyor 49. Fully loaded cases are then flapset by conventional means for shipment to the ultimate receiver.

Referring again to FIG. 1 of the drawings, conveyor 3 receives individual articles such as 51 from a second conveying means 53 moving in direction C which is substantially perpendicular to direction A. Detection means 55, such as a photoelectric device similar to the other detection means utilized, detects the arrival of an article such as 51 from conveyor 53 to conveyor 3. Detection means 55 is also in electrical communication with controller 31, which upon arrival of article 51 moves conveyor 3 a predetermined amount said to be ready for receipt of the next adjacent article 57.

Controller 31 is arranged to move conveyor 3 a predetermined distance after receipt of each individual article whereby each article is separated from adjacent articles by a consistent and substantially uniform distance. As illustrated in FIG. 1 of the drawings, the articles are substantially contiguous to one another to facilitate compact packing within case 13.

A preferred aspect of this invention is illustrated in FIGS. 2 and 3 of the drawings wherein conveyor 3 is comprised of an angular cleat surface such as 61 in order to tilt the individual articles prior to insertion into case 13. As illustrated in FIG. 2 of the drawings, case 13 includes partitions 63 and 65 so as to form three contiguous columns for receipt of individual articles. The three columns 67, 69, and 71 are substantially of the same dimension as the individual articles 7, 9, and 11 placed thereinto. By tilting the articles prior to insertion, the articles confront the column with a width less than the width of the column but upon insertion, generally conform to the width of the column. This is particularly advantageous with flexible packaging of fragile articles such as potato chips. FIG. 3 of the drawings particularly illustrates this aspect of the invention.

It should be noted that controller 31 is preferably programmed to eject articles in the loading position when there is a vacancy in one of the loading positions as detected by detectors 21, 23, or 25. With this mode of operation, each case will be completely packed. Ejection occurs by simply moving the articles off the end of conveyor 3 until detectors 21, 23 and 25 detect the presence of articles in all three locations. It should be noted that ejection does not occur when regularly shaped articles and smooth conveyors are used in conjunction with stop 33.

Figure 4:
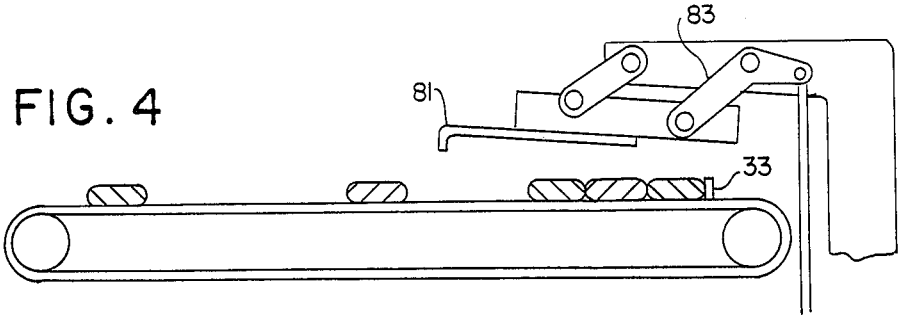
FIGS. 4, 5, and 6 of the drawings illustrate a modification of the embodiment in FIGS. 1 through 3 in a side view.
Figure 5:
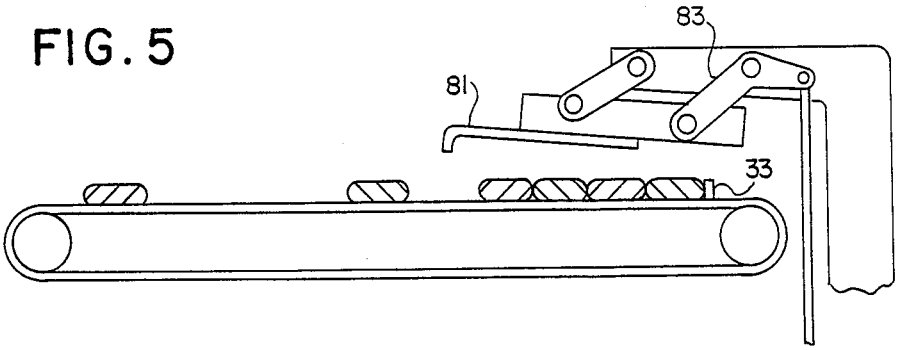
Figure 6:
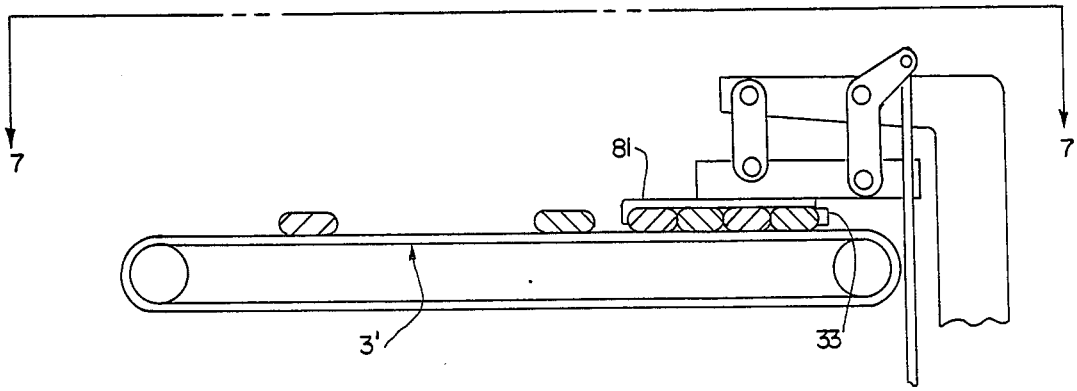

FIGS. 4, 5, and 6 illustrate another embodiment of this invention wherein compaction means 81 is utilized in conjunction with conveying means 3' and stop 33 as discussed above. FIGS. 4, 5, and 6 illustrate operation of compaction means 81 in cooperation with the movement of conveyor 3. This is particularly preferred for packages of articles in flexible containers which tend to be somewhat irregularly shaped due to the flexibility of the container.

Movement of compaction means 81 not only compresses the articles vertically, but horizontally as well due to movement of the compaction means by mechanical means 83 which comprises a lever actuator.

Compaction means 81 is activated by controller 31 upon the detection of an appropriate number of articles by detection means 21, 23 and 25. After actuation of compaction means 81, it is deactivated and returned to the FIG. 4 position to permit pusher 15 to move the individual articles into a case to form a layer.

Figure 7:
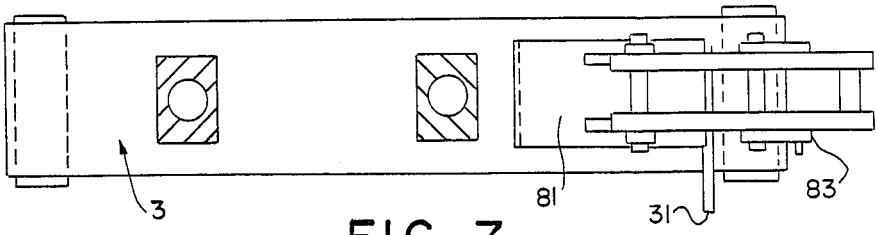
FIG. 7 of the drawings is a view along the line 7—7 of FIG. 6.

FIG. 7 is a view along the line 7—7 of FIG. 6 of the drawings, further illustrating compaction means 81.

Figure 8:
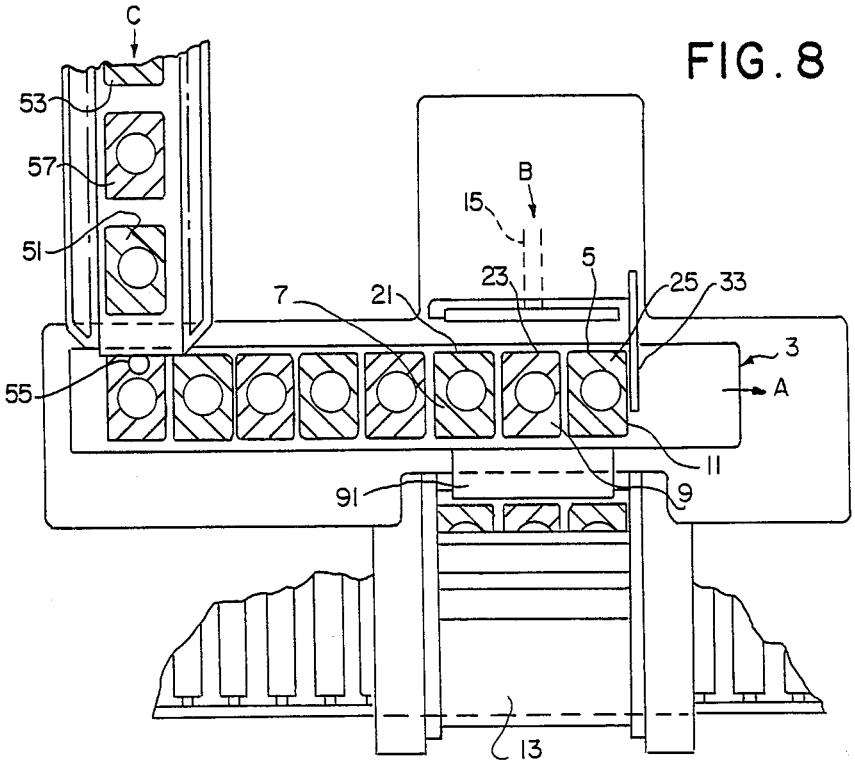
FIG. 8 of the drawings illustrate another embodiment of the invention similar to the FIG. 1 view but including additions thereto.

FIG. 8 of the drawings illustrates yet another embodiment of this invention wherein a shelf 91 cooperates with conveyor 3 and in which an extendable shelf 91 emerges from between conveyor sections of conveyor 3 into carton 13 prior to insertion of the last layer therein. The actuation of shelf 91 is brought about by controller 31. This aspect of the invention is utilized for tightly packing a plurality of articles into a case and is particularly well adapted to the repacking of cigarette cartons when it is necessary to tightly pack the last layer therein. Thus upon actuation of extendable shelf 91 into case 13, means for vertically moving, 35 and 37, move case 13 vertically upwardly a small amount to compress the lower levels and facilitate movement of the top layer thereinto. Pusher 15 thus simply pushes the top layer of individual articles across the upper surface of extendable shelf 91; whereupon extendable shelf 91 is extracted from within case 13 by means for extending the shelf in substantially the same direction as pusher 15.

It is thus seen that the apparatus of this invention provides a novel apparatus for packing a plurality of articles into a case for shipment or other utilization. The apparatus eliminates the need for manual packing and facilitates packaging of fragile articles in flexible packaging material. The apparatus further comprises means for compacting articles both before and after receipt within a case. As the above disclosure is exemplary in nature, many variations will become apparent from a reading thereof. Such variations are embodied within the spirit and scope of this invention as defined by the following appended claims.

That which is claimed is:

1. An apparatus for packing articles into a case, comprising:

first conveying means for moving a plurality of said articles seriatim in a first direction, said first conveying means being a moveable belt;

means for interrupting the movement of said articles along said first conveying means when a predetermined plural number of said plurality of articles have arrived at a location along the length of said first conveying means;

means for moving said predetermined plural number of said plurality of articles in a sidebyside relationship in a second direction which is substantially perpendicular to said first direction across said first conveying means into a case to form a first layer in said case;

means for vertically moving said case downwardly after receipt of said first layer;

means for activating said first conveying means after said means for moving has moved said predetermined plural number of articles from said location into said case for movement whereby said means for interrupting interrupts the movement of said articles when said predetermined number of articles have again arrived at said location for movement by said means for moving into said case to form subsequent layers therein;

means to detect a predetermined number of layers within said case; and means for vertically removing said case and replacing said case with a subsequent case to receive said articles.

2. The apparatus according to claim 1 further comprising a second conveying means for conveying said plurality of articles to said first conveying means.

3. The apparatus according to claim 2 further comprising means for detecting the arrival of an article from said second conveying means to said first conveying means for activating movement of said first conveying means a predetermined distance so that each article on said first conveyor is separated from adjacent articles by a predetermined distance.

4. An apparatus for packing articles into a case, comprising:

first conveying means for moving a plurality of said articles seriatim in a first direction;

means for interrupting the movement of said articles along said conveying means when a predetermined plural number of said plurality of articles have arrived at a location along the length of said conveying means;

means for moving said predetermined plural number of said plurality of articles in a sidebyside relationship in a second direction which is substantially perpendicular to said first direction into a case to form a first layer in said case;

means for vertically moving said case downwardly after receipt of said first layer;

means for activating said first conveying means after said means for moving has moved said predetermined plural number of articles from said location into said case for movement whereby said means for interrupting interrupts the movement of said articles when said predetermined number of articles have again arrived at said location for movement by said means for moving into said case to form subsequent layers therein; and an extendable shelf extending from said first conveying means at said location for insertion into said case beneath said predetermined number of said articles to compress articles in said case beneath said shelf.

5. The apparatus according to claim 4 further comprising means for extending said extendable shelf beneath only the last layer of said predetermined number of said articles to be packed in each container and wherein extension of said shelf activates vertical upward movement of said means for vertically moving said case a predetermined small amount to compress layers of articles in said case between the bottom thereof and said shelf.

* * * * *